United States Patent [19]

Lasker

[11] Patent Number: 4,907,143

[45] Date of Patent: Mar. 6, 1990

[54] REFLECTOR SYSTEM FOR FLUORESCENT TROFFER

[75] Inventor: Martin L. Lasker, Edison, N.J.

[73] Assignee: Columbia Lighting, Inc., Spokane, Wash.

[21] Appl. No.: 273,093

[22] Filed: Nov. 18, 1988

[51] Int. Cl.[4] ..... F21S 3/00

[52] U.S. Cl. ..... 362/225; 362/346; 362/290; 362/342

[58] Field of Search ..... 362/217, 216, 260, 297, 362/346, 290, 291, 349, 347, 317, 225, 247, 348, 341, 342

[56] References Cited

U.S. PATENT DOCUMENTS

| | | | |
|---|---|---|---|
| 3,591,798 | 7/1971 | Florence | 362/225 |
| 4,065,667 | 12/1977 | Rudd et al. | 362/217 |
| 4,384,318 | 5/1983 | Reibling | 362/216 |
| 4,562,517 | 12/1985 | Pankin | 362/147 |
| 4,575,788 | 3/1986 | Lewin | 362/346 |
| 4,617,612 | 10/1986 | Pritchett | 362/346 |
| 4,651,260 | 3/1987 | Lasker | 362/381 |
| 4,683,526 | 7/1987 | Krosgrud et al. | 362/346 |
| 4,747,027 | 5/1988 | Rieger | 362/346 |
| 4,760,505 | 7/1988 | Cole, Jr. | 362/225 |

FOREIGN PATENT DOCUMENTS

| | | | |
|---|---|---|---|
| 0264857 | 4/1988 | European Pat. Off. | 362/260 |
| 2190735 | 11/1987 | United Kingdom | 362/147 |

*Primary Examiner*—Ira S. Lazarus
*Assistant Examiner*—D. M. Cox
*Attorney, Agent, or Firm*—Bielen, Peterson & Lampe

[57] ABSTRACT

An upper reflector system for a fluorescent troffer utilizing a double tube florescent lamp oriented vertically relative to a downward surface to be lighted. Intersecting lower louvers form a multiplicity of cells through which the fluorescent lamp passes. An upper reflector system directs light originating with the lamp outwardly from the fixture in multiple directions.

23 Claims, 6 Drawing Sheets

REFLECTOR SYSTEM FOR FLUORESCENT TROFFER

BACKGROUND OF THE INVENTION

The present invention relates to a novel upper reflector system for a fluorescent troffer.

Work spaces are typically illuminated by the standard two foot by four foot (2×4) fluorescent troffer containing three forty watt fluorescent lamps. The parabolic louver, such as that found in the P-2 fluorescent fixture manufactured by Columbia Lighting, Spokane, Wash., represents such standard 2×4 fluorescent troffer. This standard unit possesses a parabolic louver which exhibits relatively high efficiency, low glare, and good spacing ratios perpendicular to the axis of the lamps. However, the oblong shape of the 2×4 troffer creates an orientation pattern on the ceiling which may not be compatible with the design and use of interior space being illuminated.

For purposes of aesthetic design and for greater ease of installation a square two foot by two foot (2×2) troffer would be preferred. Troffers of this dimension have been produced using two 40 watt u-shaped lamps or four two foot long 20 w lamps. Unfortunately such 2×2 troffers supply less than two-thirds of the light of the three lamp 2×4 troffers and must be spaced closer together to produce the same light levels. A more efficient "twin tube" 40 w fluorescent lamp, small enough to fit in a 2×2 troffer, has been developed. However, troffers using these lamps would still be unable to serve as a direct replacement for 2×4 troffers because of the poor distribution of light parallel to the lamp axis, i.e. outwardly from the ends of the lamp. While this poorer distribution of light in the parallel direction also occurs in standard 2×4 troffers, the four foot tube length in the parallel direction reduces the end-to-end gap between troffers and, thus, more light is provided on the working surface halfway between units. Since a 2×2 troffer does not have this compensating extra tube length, these units must be spaced more closely together in the parallel direction, resulting in the use of more troffers for a given area.

For design purposes the term "spacing ratio" may be defined as the horizontal spacing between adjacent troffers divided by the mounting height of the troffers above the working surface. The spacing ratio is used to indicate the maximum spacing which will provide uniform illumination on the surface. Existing 2'×2' troffers generally exhibit spacing ratios of about 1.5 in a plane normal or perpendicular to the lamp axis, but only about 1.2 in a plane parallel to or along the axis of the lamp and intersecting the space to be lighted. For a typical 9' ceiling and a 30" desk height (6½' mounting height) such 2×2 troffers can therefore be spaced approximately 10' apart perpendicular to the lamp axis, but only 8' apart with the lamps oriented end-to-end. Complex electronic devices in the work place exaccerbate the lighting problem since the floors of such work places are often raised six inches to accommodate cables and wires. Thus, a higher spacing ratio is required in such an area since the floor to ceiling height is decreased.

In addition, glare or brightness from fluorescent troffers at angles of 60° through 90° from nadir must be controlled in all directions. For example, video display terminals are very susceptible to glare or brightness causing obscuration of characters appearing on the screen. The mere adding of additional shielding in a troffer to block this brightness reduces the overall efficiency of the unit. With a 2×2 troffer producing the same amount of total light as a 2×4 troffer, the brightness averaged across the projected area of the troffer (average foot lamberts) could be expected to be twice as great in a 2×2 troffers in a 2×4 troffer at these higher, glare angles.

U.S. Pat. Nos. 4,065,667, 4,575,788 and 4,651,260 describe reflector systems for high intensity discharge lamps generally employed in outdoor environments. Such luminaires in the prior art are generally not adaptable to fluorescent indoor lighting systems. U.S. Pat. No. 4,562,517 shows an upper reflector system for a fluorescent lighting unit which generally controls distribution of light in the perpendicular or normal plane for use with u-shaped fluorescent tubes and circular fluorescent tubes.

A compact 2×2 troffer which solves the light distribution and glare control problems encountered in the prior art would be a great advance in the lighting field.

SUMMARY OF THE INVENTION

In accordance with the present invention a novel and useful 2×2 fluorescent troffer is provided.

The fluorescent troffer fixture of the present invention utilizes an upper reflector system, in combination with conventional louvers running parallel and perpendicular to the axis of the lamp. In addition, the fixture of the present invention employs a double tube fluorescent lamp which is oriented vertically, one tube on top of another tube, in relation to a floor or surface being illuminated a distance from the fixture. The conventional louvers form a plurality of open cells each containing the upper reflector system of the present invention. The double tube lamp would extend through each of the open cells.

The upper reflector system may include a first reflector portion positioned adjacent the twin tube lamp and canted relative to the lamp axis to project light in a "parallel" plane through the lamp axis. Such "parallel" plane would generally intersect the floor surface to be lighted and would generally be perpendicular to the same. The first reflector would also project light toward one end of the lamp such that the glare cut-off would be provided by a louver transversely oriented relative to the lamp axis. The first reflector may be faceted to obtain better control in the reduction of bands or striations of light on the working surface.

A second reflector portion may also be positioned adjacent the lamp and canted relative to the lamp axis to project light in the plane of the tubes and toward the same end of the lamp as the first reflector portion. The angle of cant of the second reflector would be greater than the first reflector. The second reflector would be spaced, or gapped, from the first reflector and extend toward the surface to be lighted at greater distance than the first reflector. A third reflector may bridge the gap between the first and second reflectors and also include a reflecting surface for projecting light toward the other end of the lamp, generally longitudinally relative to the fixture.

Four reflector units each having the first, second, and third reflectors may be arranged around each cell of the fixture, two on one side of the lamp, and two on the other side of the lamp. A fourth reflector portion may lie generally parallel to the lamp and span the pairs reflector units on the same side of the lamp. In addition, an intermediate reflector may be positioned between cells to link the adjacent first, second and third reflector units therein. Consequently, very little light is lost from the troffer of the present invention, which will be described in detail as the specification continues.

A glare cut-off member, which may be dish shaped, could be positioned atop the cross louvers i.e. perpendicular to the plane of the tubes, to further control glare on brightness in the longitudinal direction. This strict glare cut-off feature is especially important in an environment containing video display terminals.

It may be apparent that a novel and useful fluorescent lighting unit or troffer has been described.

It is therefore an object of the present invention to provide a fluorescent troffer which may be constructed in an overall size of two feet by two feet and distribute light comparable to the standard two foot by four foot troffer.

It is therefore another object of the present invention to provide a fluorescent troffer of a compact 2×2 size which provides excellent glare or brightness cut-off.

Another object of the present invention is to provide a fluorescent troffer which exhibits very high lighting efficiency.

A further object of the present invention is to provide a fluorescent troffer which distributes light uniformly in a multi-directional pattern.

Another object of the present invention is to provide a fluorescent troffer which includes an upper reflector system that is relatively simple to manufacture.

Yet another object of the present invention is to provide a fluorescent troffer which is compatible with ceiling structures and auxiliary enviromental control systems in a work space, such as ventilation ducts, electrical conduits and the like.

The invention possesses other objects and advantages especially as concerns particular characteristics and features thereof which will become apparent as the specification continues.

Various aspects of the present invention will evolve from the following detailed description of the preferred embodiments thereof, which should be referenced to the hereabove described drawings.

DETAILED DESCRIPTION OF THE PREFERRED EMBODIMENTS

Various aspects of the present invention will evolve from the following detailed description of the preferred embodiments in accordance with the hereinabove described drawings.

Figure 1:
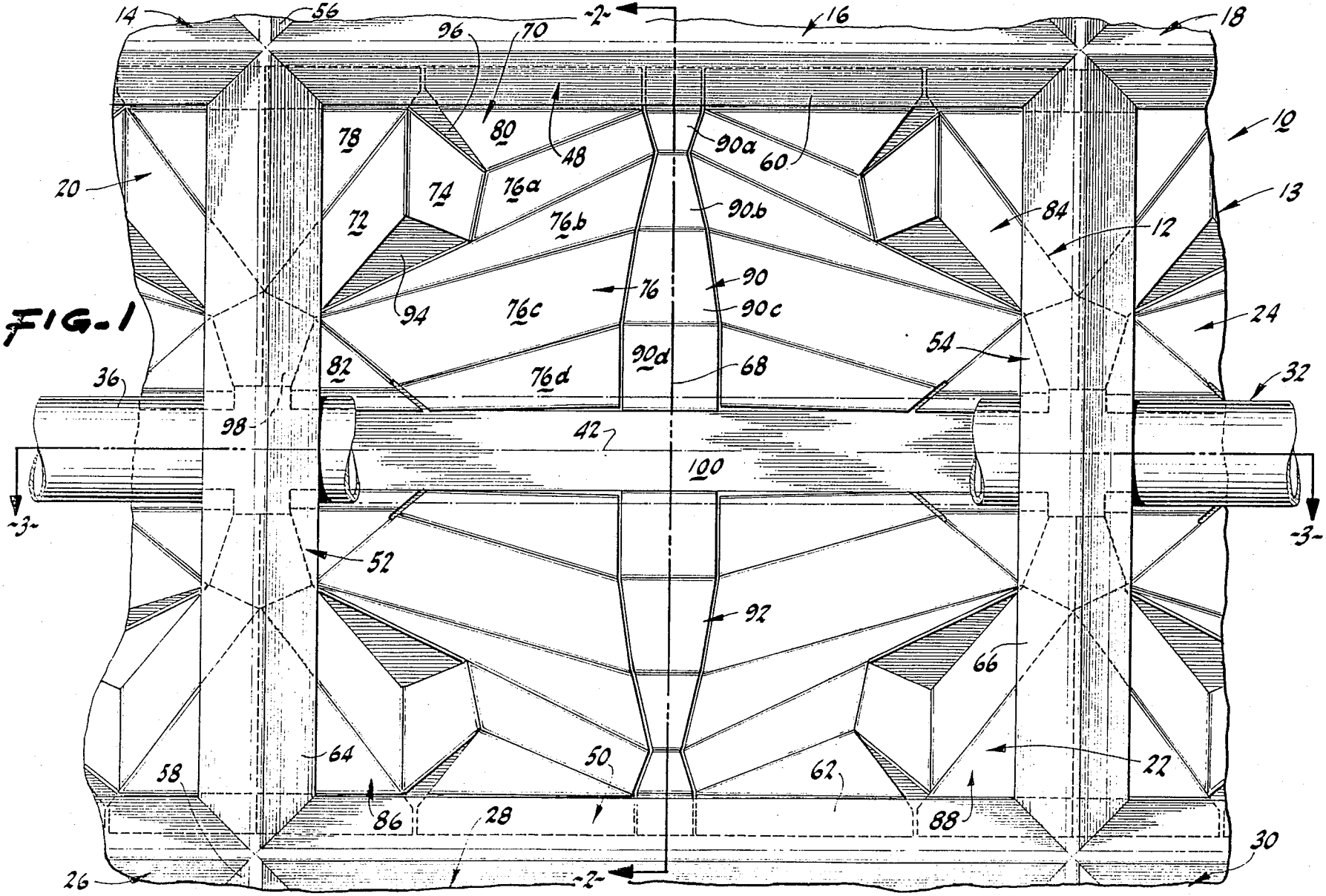
FIG. 1 is a bottom plan view of the troffer of the present invention showing a typical upper reflector system of a single cell and portions of a pair of adjacent cells in broken configuration.
Figure 2:
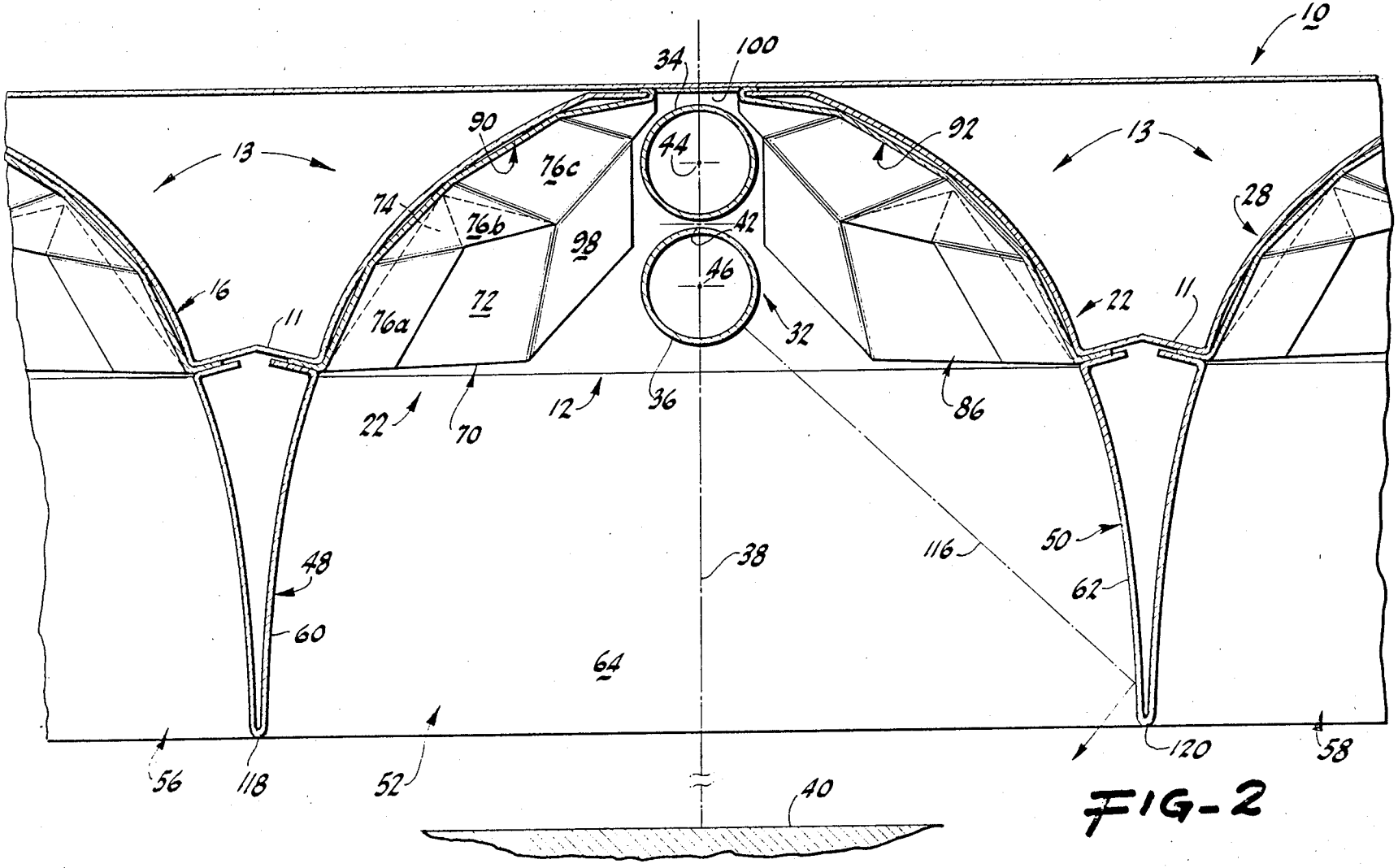
FIG. 2 is a sectional view taken along line 2—2 of FIG. 1.

The invention as a whole is depicted in the drawings by reference character 10. The 2×2 troffer 10 includes as one of its elements an upper reflector system 12, best shown in FIGS. 1–3. Troffer 10 generally has an overall dimension of 2 feet by 2 feet and includes nine cells, 14, 16, 18, 20, 22, 24, 26, 28, and 30. For the sake of illustration, only cell 22 is shown in its entirety, since the remaining cells are substantially identical thereto. Likewise, lamp 32 is of a compact nature having a length of about twenty two inches, which permits lamp 32 to extend through cells 20, 22, and 24, FIG. 1. It should be understood that identical lamps (not shown) to lamp 32 extend through cells 14, 16, and 18, and cells 26, 28, and 30. With reference to FIG. 2, the compactness of lamp 32 is illustrated. Typically lamp 32 includes a pair of tubes 34 and 36 each having a diameter of 11/16 of an inch and lying between one another, center-to-center, about $\frac{3}{4}$ of an inch. This leaves a gap of $\frac{1}{8}$ of an inch between the tubes 34 and 36 and provides for an overall vertical height of one and one half inches. Lamp 32 is oriented along a vertical axis 38 which is perpendicular to the floor or surface 40 (at nadir) being illuminated outwardly from troffer 10. In addition, lamp 32 possesses an axis 42 of elongation which lies parallel to axes 44 and 46 of tubes 34 and 36, respectfully. Lamp 32 may be of the Biax type, forty watt, manufactured by the General Electric Co., Schenectady, N.Y.

Multiplicity of cells 13 are formed by intersecting louvers such as louvers 48 and 50 being intersected by louvers 52 and 54 to form cell 22. Troffer 10 includes additional louvers to form multiplicity of cells 13 in the same manner. For example, FIG. 2 depicts additional louvers 56 and 58. In general, louvers 50, 52, 56 and 58 shown in FIG. 2 include prior art parabolic reflecting surfaces such as surfaces 60 and 62 of louvers 48 and 50, respectfully. Moreover, louvers 52 and 54 include parabolic reflecting surfaces 64 and 66, respectfully, FIG. 3. As depicted in the figures, plurality of louvers 47 generally lie between surface 40 and lamp 32.

Returning to FIG. 1, it should be observed that open cell 22 includes an upper reflector system 12 that is symmetrical on either side of longitudinal axis 42 as well as either side of transverse axis 68. Reflector unit 70 includes reflector portions 72, 74, and 76. Reflector portions 72 and 76 are faceted; reflector portion 72 including reflector *72a* and reflector 76 having reflector facets *76a*, *76b*, *76c* and *76d*. Reflector portions 78, 80, and 82 are also depicted as a part of reflector unit 70. Reflector units 84, 86 and 88 are substantially identical to reflector unit 70, except that reflector units 84 and 88 are the mirror image thereof. Faceted reflector portion 90 having facets 90A, 90B, 90C, 90D, and reflector portion 92 interconnect the apex between reflector units 70 and 84, and reflector units 86 and 88, respectively. It should be noted that openings 94 and 96 are shown in the drawings with reference to reflector unit 70. Corresponding openings are found in reflector units 84, 86, and 88. Of course such openings, such as openings 94 and 96 do not include a reflective surface but are not seen by the lamp. In other words, such openings do not receive light and, thus, do not affect efficiency. In addition, reflector portion 98 serves as a intermediate reflector in the upper reflector system of cell 22 and the identical upper reflector system partially depicted in FIG. 1 for cell 20. Immediately above lamp 32 lies diffuser surface 100 which serves to disperse light away from lamp 32.

Figure 4:
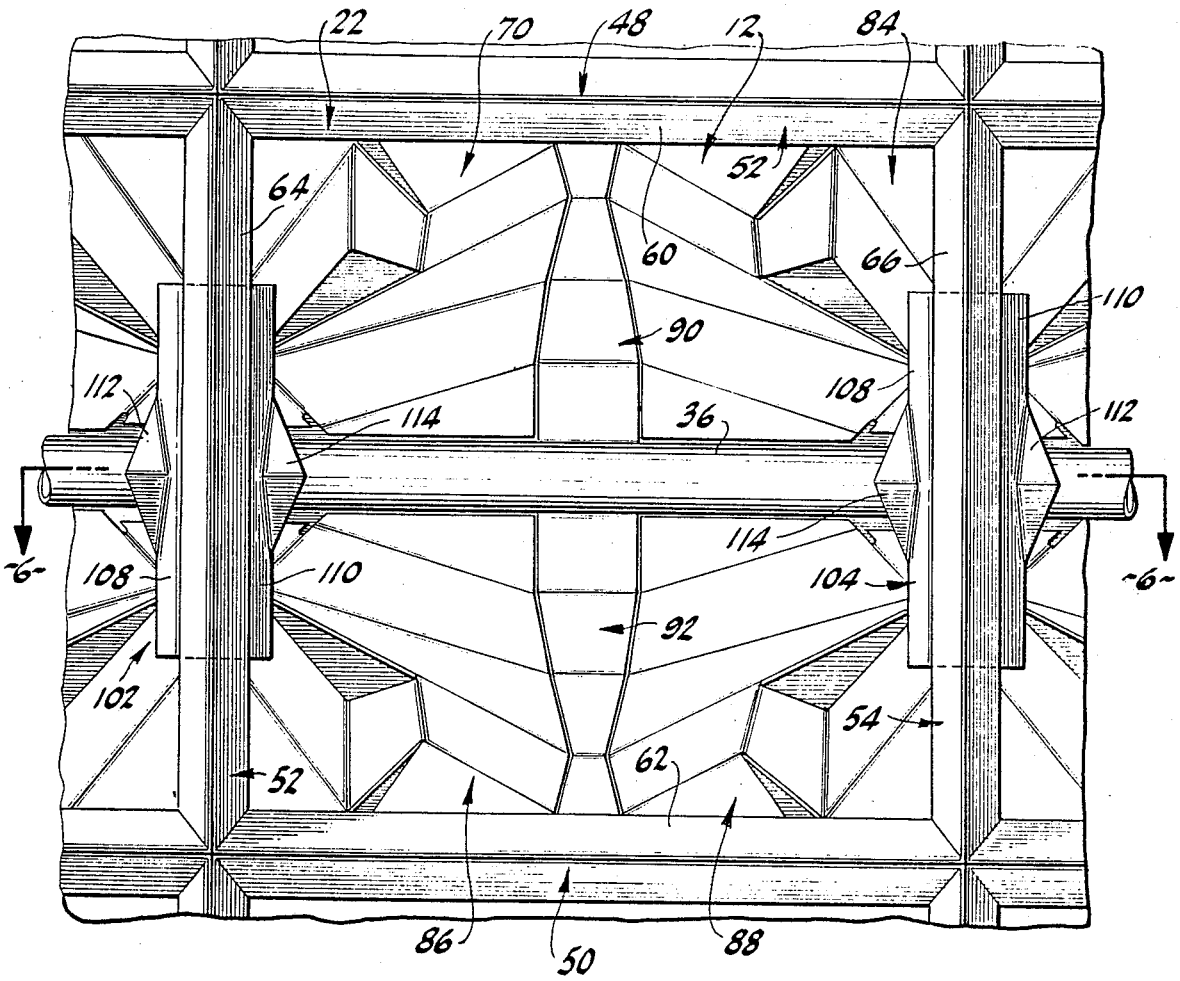
FIG. 4 is a bottom plan view of an alternate embodiment of the present invention, including a glare cut-off accessory.
Figure 5:
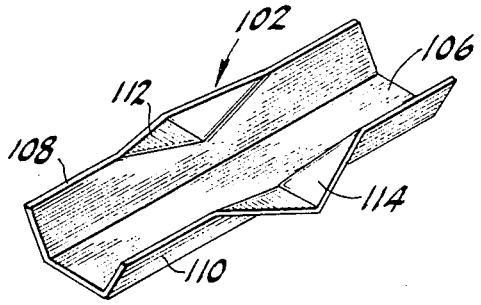
FIG. 5 is a top, right, front, perspective of the glare cut-off accessory depicted in plan view in FIG. 4.

With reference to FIG. 4, upper reflector system is depicted with a pair of glare cut-off baffles 102 and 104 which are located atop across louvers 22 and 54, respectively. It may be seen from FIG. 5, baffle 102 depicted in its entirety reveals an elongated base 106 having a pair of wings 108 and 110 extending upwardly at an obtuse angle from base 106. Side channels 112 and 114 accommodate lamp tube 36.

Upper reflector system 12 may be constructed of sheet metal, plastic, or other suitable specular material which is capable of being molded, bent or otherwise formed into the shapes depicted in the drawings. Preferably, the reflector units 70, 84, 86, and 88 are prefinished with a specular surface and then bent and blanked on a progressive die apparatus. Such units include interconnecting apex reflector portions 90 and 92. Reflector portions are fixed to tray 11 by tabs, screws, or other suitable means. Reflector portions, such as portion 98 also optically span the corresponding reflector systems in the adjacent cells, i.e. cells 20 and 24 adjacent cell 22 illustrated in the drawings.

Figure 3:
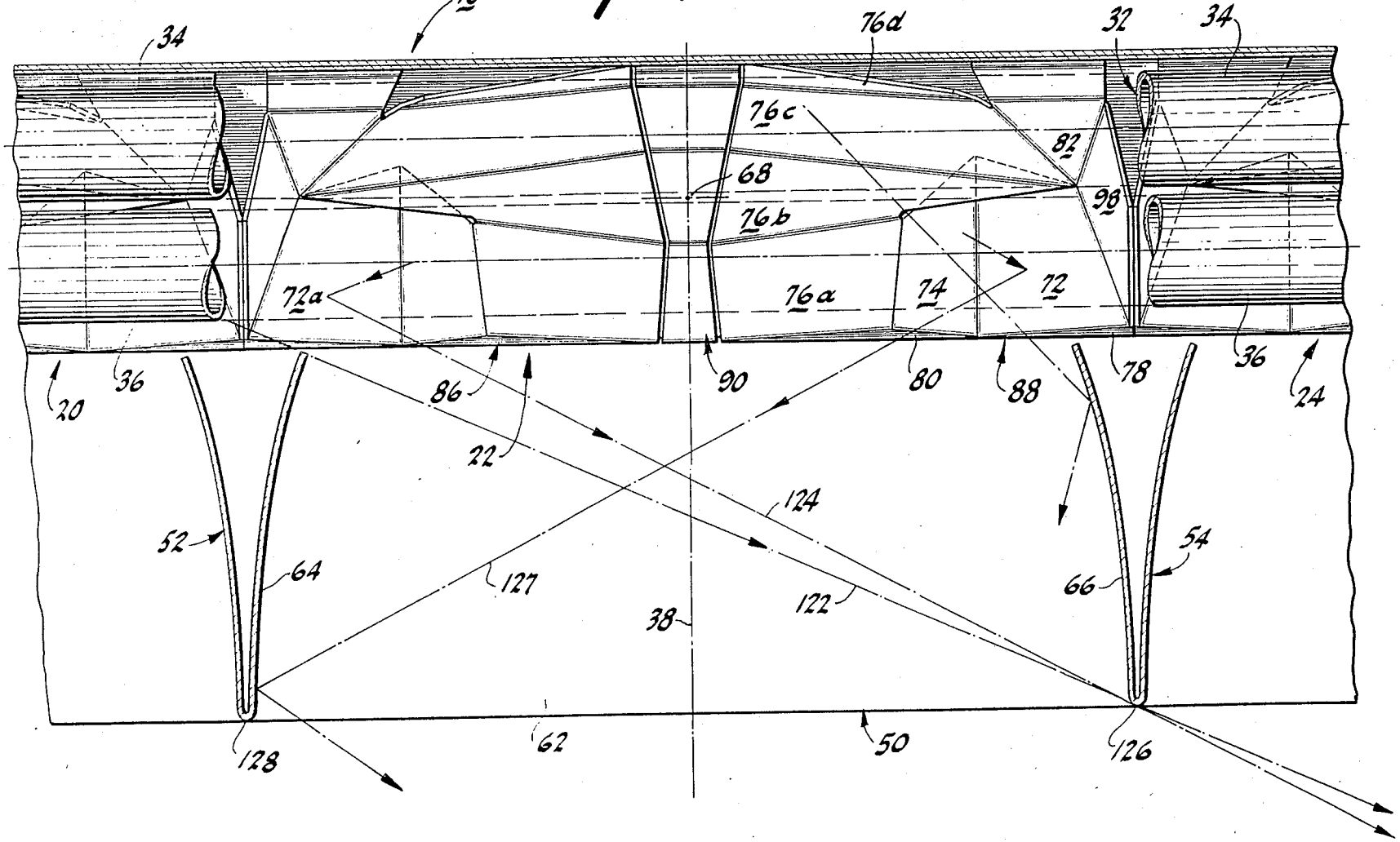
FIG. 3 is a sectional view taken along line 3—3 of FIG. 1 and includes ray lines depicting certain types of light distribution.
Figure 6:
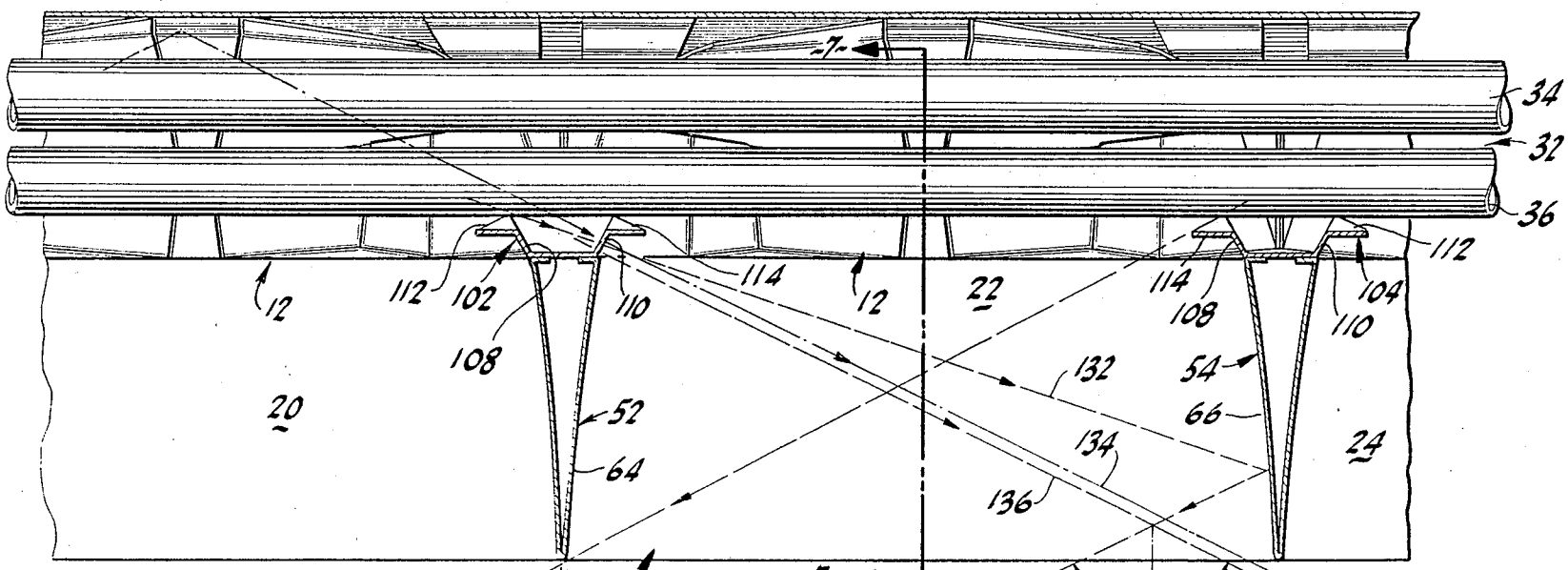
FIG. 6 is a sectional view taken along line 6—6 of FIG 4 illustrating ray lines representing the glare cut-off capabilities of the accessory depicted in FIGS. 4 and 5.

In operation, with respect to FIGS. 2, 3, and 6 in particular, light emanates from tubes 34 and 36 of lamp 32 in all directions. With respect to FIGS. 2, it may be seen that ray line 116 shows the normal reflection from louver 50 reflecting surface 62 toward the surface 40 to be lighted. The ends 118 and 120 of louvers 48 and 50 serve as a glare cut-off in the normal or perpendicular direction i.e. in a plane encompassing transverse axis 68 which is generally perpendicular to surface 40. In other words, ends 118 and 120 serve as a glare cut-off in the "normal" plane heretofore described. Such glare cut-off is very accurate in troffer 10 to reduce brightness or glare over 90% between 45° and 50° relative to the vertical axis 38. With respect to FIG. 3, light is very efficiently controlled in the "parallel" plane which is coincident with axes 42, 44, and 46 and also intersect surface 40 at generally a right angle. In other words, upper reflector system 12 spreads light outwardly from troffer 10 toward the ends of tubes 34 and 36. For example, ray line 122 indicates the passage of direct light from lamp 32 escaping reflector by louver 54 up to an angle of 66° from axis 38, which represents the nadir. Ray line 124 emanates from lamp 32 and reflects from reflector portion 72A' of reflector unit 84, a facet comparable to reflector portion 72 of reflector unit 70, heretofore described. Ray line 124 continues until passing from troffer 10 at a maximum angle of about 62°-63° from nadir, representing the highest angle of light reflected from troffer 10 in the parallel direction. Thus, ends 126 and 128 of louvers 52 and 54 respectively serve as glare cut-off entities for troffer 10 in the "parallel" direction. Ray line 127 indicates light reflected from reflector portion 72, with a glare potential that is intercepted by louver 54. Ray 127 leaves troffer 10 after reflection at an angle of no higher than 63°. When viewed from nadir, along axis 38, reflector portions 76C, 76D, 90C, and 90D reflect light directly downwardly. Reflector portions 72, 74, 76A, 76B, 90A, and 90B do not provide lighting along axis 38. In the "normal" direction starting from axis 38 and viewing the troffer 10 from below toward axis 68, reflector portions 74, 76A, 76B, 90A, and 90B project light, by direct reflection from lamp 32 the intensity peaking at 25°-30° from nadir in the "normal" plane encompassing axis 68. Reflector portions 72 and 74 also project light after interreflection. After 30° from nadir in the normal plane, the image of the lamp begins to "ride off" reflector portions 74, 76A, 76B, 90A, and 90B until virtually no light is reflected from these reflector elements, at 35°. A peak of intensity of 35° from nadir in the normal plane is caused almost entirely by the light being reflected by transverse louvers, such as louvers 48 and 50. It should be noted that only a small section of reflector 72 provides light in the normal direction, FIG. 2.

In viewing the troffer in the "parallel" plane, i.e. a plane encompassing axes 42, 44, and 46, all facets of typical reflector unit 70 are "flashed", or reflect light, to a maximum at about 35° from nadir. Above 35°, the image of the lamp begins to "ride off" reflector portions 72, 74, 76A and 90A. Above this angle, light from these facets tends to be increasingly intercepted and reflected by transverse louvers, such as louvers 52 and 54, and continues to the extremities heretofore described with reference to ray lines 122 and 124.

Figure 8:
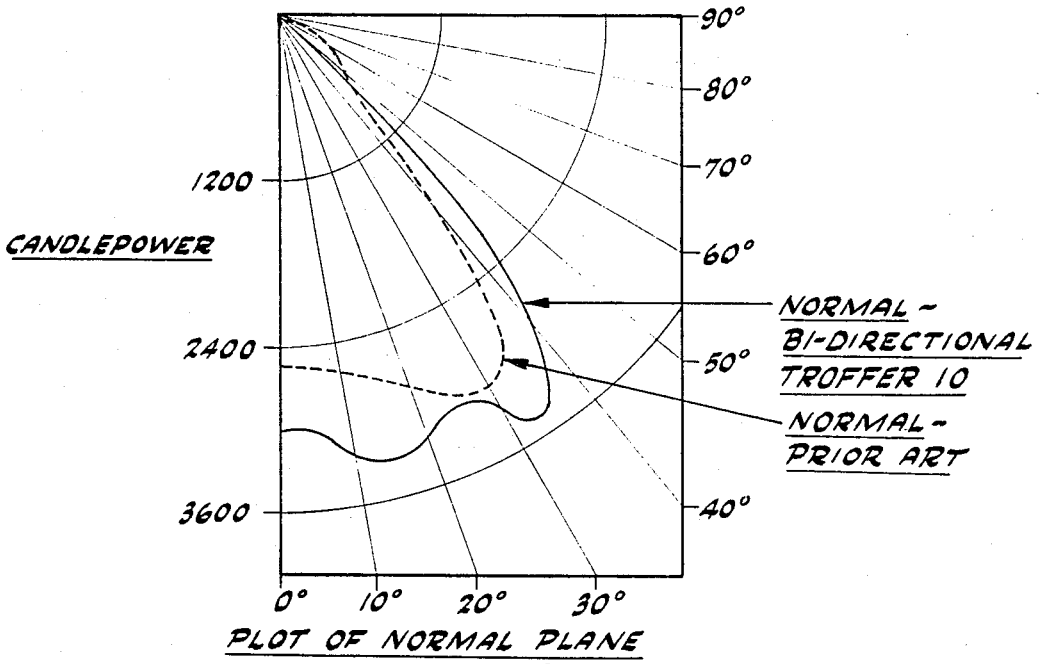
FIG. 8 is a graphical representation of the candle power distribution of the troffer of the present invention in the normal plane compared to the prior art 2×2 troffer.
Figure 9:
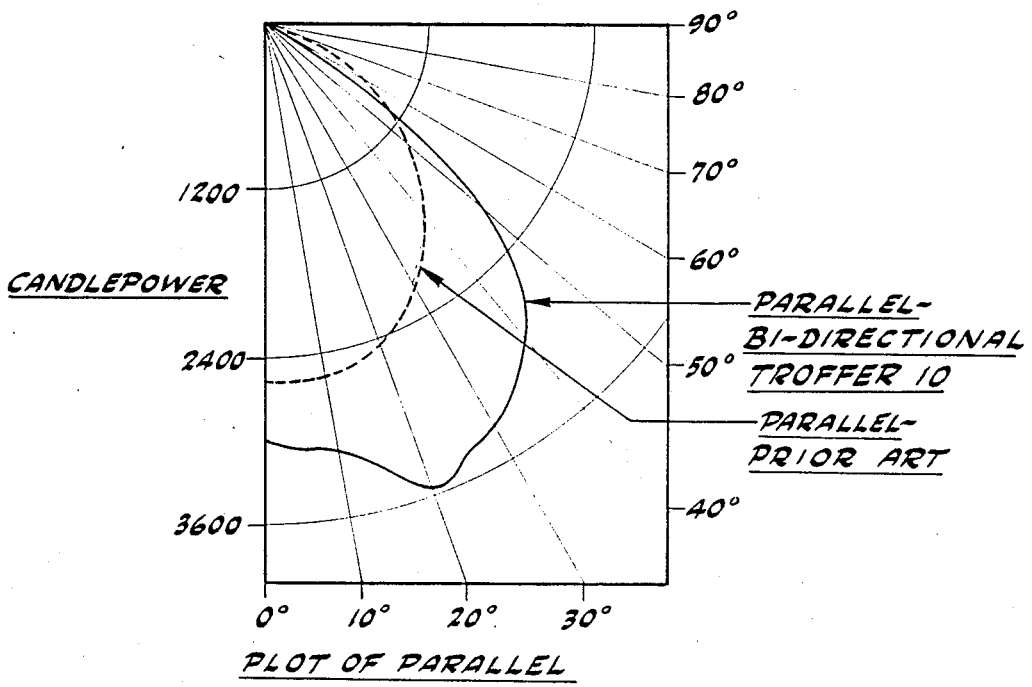
FIG. 9 is a graphical representation, of the candle power distribution of the troffer of the present invention in the parallel plane compared to the prior art 2×2 troffer.

FIGS. 8 and 9 depict a comparison of the heretofore described prior art 2×2 troffer with the bi-directional troffer 10 of the present invention. FIG. 8 represents a plot of the "normal" plane encompassing axis 68. Further, FIG. 9 represents a plot of light projected in the "parallel" plane i.e. a plane encompassing axes 42, 44, and 46, FIG. 2. As may be observed, the troffer of the present invention represents a significant improvement in light projection the parallel plane, graph line 130. The intensity of light has been increased below 55° as compared to prior art with maximum intensities between 15° and 35° to form the batwing curve which permits greater spacing ratios. Glare intensity, at angles over 55°, has been reduced from that of the prior art. The normal plane, graph line 128, shows the intensities peaking at 35° with no less efficiency than in the prior art and with reduced intensities at glare angle above 45°. The following example represents the source of the data for FIGS. 8 and 9:

EXAMPLE 1

The following candle power distribution was obtained utilizing 2×2 troffer 10 of the present invention and a Leviton socket #26726 for a 9 cell unit. The lamps were rated at 3150 lumens each. Illuminance area was 21.3×7 feet. The lamps used were bias dual tube fluorescent lamps 22½ inches in length manufactured by General Electric. The following measurements were acquired:

| | MEASURED CANDLEPOWER 2 × 2 TROFFER 10 | | | | |
|---|---|---|---|---|---|
| DEGREE | PARALLEL | 22.5 | 45 | 67.5 | NORMAL |
| 6 | 2910 | 2910 | 2910 | 2910 | 2910 |
| 5 | 2970 | 2931 | 2964 | 2922 | 2943 |
| 10 | 3012 | 2991 | 3000 | 3123 | 3168 |
| 15 | 3201 | 3072 | 3105 | 3264 | 3318 |
| 20 | 3471 | 3186 | 3123 | 3189 | 3180 |

-continued

| DEGREE | MEASURED CANDLEPOWER 2 × 2 TROFFER 10 PARALLEL | 22.5 | 45 | 67.5 | NORMAL |
|---|---|---|---|---|---|
| 25 | 3426 | 3207 | 3030 | 2970 | 2931 |
| 30 | 3285 | 3084 | 2904 | 3006 | 3141 |
| 35 | 3123 | 2988 | 2886 | 2248 | 3432 |
| 40 | 2952 | 2856 | 2886 | 3006 | 2733 |
| 45 | 2742 | 2478 | 2574 | 7148 | 1539 |
| 50 | 2253 | 1971 | 1551 | 381 | 138 |
| 55 | 1341 | 1383 | 528 | 75 | 57 |
| 60 | 528 | 657 | 72 | 48 | 54 |
| 65 | 275 | 112 | 39 | 39 | 36 |
| 70 | 21 | 12 | 12 | 6 | 6 |
| 75 | 9 | 6 | 6 | 3 | 3 |
| 80 | 3 | 3 | 3 | 3 | 3 |
| 85 | 3 | 3 | 0 | 0 | 0 |
| 90 | 0 | 0 | 0 | 0 | 0 |

The following values were obtained with a prior art Columbia Lighting 2×2 P4 troffer, 9 cell semi-specular louver luminaire using the same three dual tube lamps manufactured by General Electric, employed above in conjunction with troffer 10, above.

| DEGREE | MEASURED CANDLEPOWER PRIOR ART 2 × 2 TROFFER PARALLEL | 22.5 | 45 | 67.5 | NORMAL |
|---|---|---|---|---|---|
| 0 | 2559 | 2559 | 2559 | 2559 | 2559 |
| 5 | 2545 | 2550 | 2559 | 2566 | 2568 |
| 10 | 2498 | 2513 | 2550 | 2596 | 2611 |
| 15 | 2426 | 2453 | 2557 | 2678 | 2718 |
| 20 | 2335 | 2389 | 2581 | 2779 | 2855 |
| 25 | 2230 | 2328 | 2608 | 2915 | 3022 |
| 30 | 2102 | 2252 | 2648 | 2931 | 3019 |
| 35 | 1948 | 2157 | 2601 | 2791 | 2811 |
| 40 | 1772 | 2039 | 2371 | 2073 | 1686 |
| 45 | 1574 | 1874 | 1920 | 959 | 850 |
| 50 | 1348 | 1603 | 1025 | 667 | 658 |
| 55 | 1084 | 1184 | 569 | 499 | 503 |
| 60 | 803 | 731 | 377 | 338 | 334 |
| 65 | 396 | 279 | 194 | 156 | 128 |
| 70 | 55 | 51 | 54 | 31 | 28 |
| 75 | 24 | 22 | 19 | 18 | 15 |
| 80 | 13 | 12 | 10 | 9 | 9 |
| 85 | 4 | 4 | 4 | 3 | 3 |
| 90 | 0 | 0 | 0 | 0 | 0 |

The 2×2 troffer 10 of the present invention may be considered to be a "bi-directional" design since the distribution of light shown in FIGS. 8 and 9 produced a bat-wing curve in all measured directions. Most importantly, a 1.56 ratio of spacing to mounting height resulted in both "normal" and "parallel" directions. In a typical large work bay having a nine foot ceiling and thirty inch high working surface (6½ foot mounting height), a the 1.56 spacing ratio permits troffer 10 to be spaced on a 10×10 foot square grid pattern which is ideal for both efficiency and appearance, therein. Conversely, the prior art 2×2 troffer depicted in Example 2 and FIGS. 8 and 9 cannot produce uniform illumination in the parallel plane when placed on ten foot centers. That is to say, the prior art 2×2 troffers must be spaced no more then eight feet apart in this situation. Also, the 2×2 troffer 10, of the present invention, achieves a fixture efficiency of approximately 74% with a specular parabolic louver and 72.9% with a semi-specular louver. In both cases the material of the upper reflector segments is highly specular and possess a reflectivity of 94%. By comparison, the conventional prior art unit achieved only a 61.6% efficiency using a semi-specular louver and a conventional gloss white reflector with 88% reflectivity above the lamp. Thus, the same illumination may be produced with troffer 10 with 20% less fixtures, lamps and energy consumption than the prior art units (based on 8×10 foot spacing of prior art unit). If the prior art unit is placed on 8×8 foot spacing, comparitive energy usage for troffer 10 is less by approximately 36%.

The following Example II represents the glare control and fixture efficiency comparison of 2×2 troffer 10 and the prior art 2×2 troffer and 2×4 troffer.

EXAMPLE II

The Zonal Summary and Average Foot-Lamberts (Avg. FL) in the normal (NORM) and parallel (PARL) planes results obtained utilizing the same lamps and 2×2 troffers depicted in Example I. The 2×4 prior art troffer results derived from a P-4 fluorescent fixture manufactured by Columbia Lighting, Spokane, Wash. The P-4 fluorescent fixture included an 18 cell semi-specular louver, three F40T12 CW lamps, and advance ROM-2540-3-TP and HM-140-1-TP ballasts. All angles and zones are measured from nadir.

| ZONAL SUMMARY ZONE | LUMENS | LAMP | FIXT. | AVG. FL. DEG | PARL | NORM |
|---|---|---|---|---|---|---|
| 2 × 2 TROFFER 10 | | | | | | |
| 0–30 | 873 | 27.7 | 37.4 | 0 | 2944 | 2944 |
| 0–40 | 1511 | 48.0 | 64.8 | 45 | 3923 | 2203 |
| 0–60 | 2290 | 72.7 | 98.3 | 55 | 2366 | 98 |
| 0–90 | 2333 | 74.1 | 100.0 | 65 | (650)* | 85 |
| 90–180 | 0 | 0.0 | 0.0 | 75 | 33 | 14 |
| 0–180 | 2333 | 74.1 | 100.0 | 85 | 26 | 10 |
| PRIOR ART COLUMBIA LIGHTING P-4 2 × 2 TROFFER | | | | | | |
| 0–30 | 2178 | 23.1 | 37.4 | 0 | 2561 | 2561 |
| 0–40 | 3788 | 39.0 | 63.2 | 45 | 2228 | 1204 |
| 0–60 | 5549 | 58.7 | 95.3 | 55 | 1892 | 878 |
| 0–90 | 5823 | 61.6 | 100.0 | 65 | 938 | 303 |
| 90–180 | 0 | 0.0 | 0.0 | 75 | 92 | 58 |
| 0–180 | 5923 | 61.6 | 100.0 | 85 | 51 | 34 |
| PRIOR ART COLUMBIA LIGHTING P-4 2 × 4 TROFFER | | | | | | |
| 0–30 | 2222 | 23.2 | 32.5 | 45 | 988 | 1110 |
| 0–40 | 3785 | 39.4 | 55.3 | 55 | 988 | 547 |
| 0–60 | 6365 | 66.3 | 93.1 | 65 | 611 | 201 |
| 0–90 | 6838 | 71.2 | 100.0 | 75 | 55 | 41 |
| 0–180 | 6838 | 71.2 | 100.0 | 85 | 20 | 20 |

*approximate value

The above results indicates that troffer 10 of the present invention only permits 1.4% of lamp lumens to egress in the zone between 60° and 90°. By comparison the prior art 2×2 and 2×4 troffers permitted 2.9% and 4.9% lamp lumens in the zones between 60% and 90% from nadir, respectively.

Figure 7:
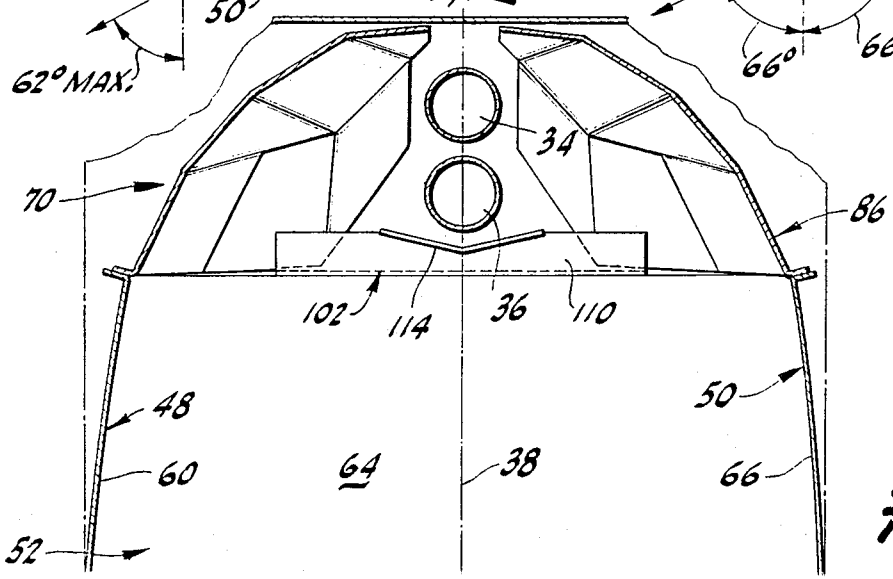
FIG. 7 is a sectional view taken along line 7—7 of FIG. 6.

In addition, the accessory baffles 102 and 104 may be used as depicted in FIGS. 6 and 7 to intercept high angle rays (above 62° in the parallel direction), such as 134 and 136, representing glare light reflected from upper reflector system 12 and light directly emanating from lamp 32, respectively. Also, ray 132, FIG. 6, from the lamp and upper reflector system 12 is re-reflected from louver 54 to a non-glare angle. Such vigorous blocking of glare is sometimes necessary to prevent image obscuring reflections of the 2×2 troffer 10 on video display terminals. It has been found that use of baffles 102 and 104 reduces the overall efficiency of troffer 10 only by about 4%, an acceptable trade-off for the strict cut-off in the parallel plane.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An upper reflector system for a fluorescent fixture for lighting a surface utilizing an axially elongated double tube fluorescent lamp having one and another ends, the tubes being separated within a plane encompassing the lamp axis and intersecting the surface to be lighted, a first pair of opposed louvers below the lamp extending generally parallel to the elongated axis of the lamp and a second pair of opposed louvers positioned generally perpendicularly to said first pair of spaced louvers, said first and second pairs of louvers forming an open cell through which the lamp extends, the upper reflector system comprising:

a. a first reflector portion positioned adjacent the lamp and canted relative to the lamps axis to project light in a plane encompassing the lamp axis and intersecting the space to be lighted, and to project light generally toward one end of the lamp; and b. a second reflector portion positioned adjacent the lamp and canted relative to the lamp axis to project light in said plane encompassing the lamp axis, and generally toward one end of the lamp; said first and second reflector portions also extending toward the opposed first and second pairs of spaced louvers, said second reflector portion extending further toward the first and second louvers than said first reflector, said first and second reflector portions being positioned to form a gap therebetween.

2. The upper reflector system of claim 1 which further comprises a third reflector portion bridging said gap between said first and second reflector portions, said third reflector portion being canted relative to the lamp axis to project light in said plane encompassing the lamp axis generally toward the other end of the lamp.

3. The upper reflector system of claim 1 in which said first reflector portion is faceted.

4. The upper reflector system of claim 3 in which said second reflector portion is faceted.

5. The upper reflector system of claim 1 which includes a quartet of said first and second reflector portions arranged about the cell formed by said first and second pairs of louvers.

6. The upper reflector system of claim 1 which further comprises a third reflector portion extending between said first and second reflector portions, said third reflector portion being canted relative to the lamp axis to project light in said plane encompassing the lamp axis generally toward the other end of the lamp.

7. The upper reflector system of claim 1 in which said first reflector portion is faceted.

8. The upper reflector system of claim 3 in which said second reflector portion is faceted.

9. The upper reflector system of claim 1 which includes a quartet of said first and second reflector portions arranged about the cell formed by said first and second pairs of louvers.

10. A fluorescent fixture lighting a surface used in combination with an axially elongated double tube fluorescent lamp having one and another ends, the tubes being positioned for separation within a plane encompassing the lamp axis and intersecting the surface to be lighted, a first and second group of opposed louvers positioned between the upper reflector system and the surface to be lighted, the first group of opposed louvers oriented generally perpendicularly relative to said second group of opposed louvers, said first and second groups of opposed louvers forming at least a pair of open cells, the lamp extending into each of the pair of open cells, the improvement comprising an upper reflector system in each of the open cells, including:

a. a first reflector portion positioned adjacent the lamp and canted relative to the lamp axis to project light in the plane of the tubes toward one end of the lamp;

b. a second reflector portion positioned adjacent the lamp and canted relative to the lamp axis to project light in the plane of the tubes, toward one end of the lamp; said first and second reflector portions being positioned to form a gap therebetween; the first and second groups of louvers lying between the surface to be lighted and said first and second reflector portions.

11. The fluorescent fixture improvement of claim 10 which further comprises a third reflector portion bridging said gap between said first and second reflector portions, said third reflector portions being canted relative to the lamp axis to project light in the plane of the tubes toward the other end of the lamp.

12. The fluorescent fixture improvement of claim 10 in which said first reflector portion is faceted.

13. The fluorescent fixture improvement of claim 12 in which said second reflector portion is faceted.

14. The fluorescent fixture improvement of claim 10 which includes two pairs of first and second reflector portions arranged about each pair of open cells.

15. The fluorescent fixture improvement of claim 14 which includes a fourth reflector portion lying generally parallel to the lamp axis and spanning each pair of said first and second reflectors.

16. The fluorescent fixture improvement of claim 10 which further comprises an intermediate reflector, spanning said pair of first and second reflectors includes in each pair of open cells.

17. A fluorescent lighting unit for lighting a surface comprising:

a. an axially elongated double tube lamp having one and another ends, said tubes being positioned for separation within a plane encompassing the lamp axis and intersecting the surface to be lighted, b. a pair of louvers extending substantially parallel to the lamp axis;

c. a trio of louvers lying substantially perpendicularly to said first pair of louvers forming a pair of open cells through said lamp extends;

d. an upper reflector system means for projecting substantial light emanating from said lamp along said lamp axis toward said one another lamp ends; said pair and trio of louvers lying between said upper reflector system means and the surface to be lighted.

18. The fluorescent lighting unit of claim 17 in which said upper reflector system means includes each of said cells having first and second reflector portions each positioned adjacent the lamp and canted relative to the lamp axis to project light in said plane of the tubes.

19. The fluorescent lighting unit of claim 18 in which said first and second reflector portions are positioned to form a gap therebetween, and the light projected in the plane of the tubes being further projected toward said one end of said lamp.

20. The fluorescent lighting unit of claim 19 which further comprises a third reflector portion bridging said gap between said first and second reflector portions, said third reflector portion being canted relative to the lamp axis to project light in said plane of the tubes toward the other end of the lamp.

21. The fluorescent lighting unit of claim 19 which further includes a light cut-off member fastened to the inward extremity at least one of said trio of louvers extending inwardly relative to one of said open cells.

22. The fluorescent lighting unit of claim 17 which said upper reflector system means is shaped and arranged to generate a light intensity distribution in a parallel plane containing said lamp axis substantially in accordance with the distribution curve 130 illustrated in FIG. 9.

23. An upper reflector system for a fluorescent fixture for lighting a surface utilizing an axially elongated double tube fluorescent lamp having one and another ends, the tubes being separated within a plane encompassing the lamp axis and intersecting the surface to be lighted, a first pair of opposed louvers below the lamp and a second pair of opposed louvers positioned transversely relative to said first pair of opposed louvers, said first and second pairs of louvers forming an open cell through which the lamp extends, the upper reflector system, comprising:

a. a first reflector portion positioned adjacent the lamp and canted relative to the lamp axis to project light in a plane encompassing the lamp axis and intersecting the space to be lighted, and to project light generally toward one end of the lamp; and b. a second reflector portion positioned adjacent the lamp and canted relative to the lamp axis to project light in said plane encompassing the lamp axis and generally toward one end of the lamp; said first and second reflector portions also extending toward the opposed first and second pairs of spaced louvers, said second reflector portion extending further toward the first and second louvers than said first reflector.

* * * * *